US006575112B2

(12) United States Patent
Roeseler et al.

(10) Patent No.: US 6,575,112 B2
(45) Date of Patent: Jun. 10, 2003

(54) ELEVATED TOW APPARATUS

(75) Inventors: Cory Roeseler, Hood River, OR (US); Andreas H. von Flotow, Hood River, OR (US)

(73) Assignee: Hood Technology Corporation, Hood River, OR (US)

( * ) Notice: Subject to any disclaimer, the term of this patent is extended or adjusted under 35 U.S.C. 154(b) by 0 days.

(21) Appl. No.: 09/970,127

(22) Filed: Oct. 3, 2001

(65) Prior Publication Data

US 2002/0046690 A1 Apr. 25, 2002

Related U.S. Application Data

(63) Continuation-in-part of application No. 09/772,426, filed on Jan. 29, 2001.

(60) Provisional application No. 60/179,524, filed on Feb. 1, 2000.

(51) Int. Cl.[7] ..... B63B 21/04

(52) U.S. Cl. ..... 114/253; 114/242; 114/121

(58) Field of Search ..... 114/242, 244, 114/246, 247, 253, 254, 126, 102.1, 102.11, 102.12, 102.13, 102.16, 102.18, 102.22

(56) References Cited

U.S. PATENT DOCUMENTS

| | | | | | |
|---|---|---|---|---|---|
| 478,841 | A | * | 7/1892 | Bodette | 182/118 |
| 606,104 | A | * | 6/1898 | Twining | 114/39.28 |
| 2,608,172 | A | * | 8/1952 | Biuw | 114/102.27 |
| 3,326,175 | A | * | 6/1967 | Baker | 114/254 |
| 3,724,595 | A | * | 4/1973 | Green | 182/118 |
| 3,776,170 | A | * | 12/1973 | Slemmons | 114/102.13 |
| 3,924,870 | A | * | 12/1975 | Spivack et al. | 280/11.37 S |
| 3,987,746 | A | * | 10/1976 | McCulloh | 114/235 R |
| 4,738,414 | A | * | 4/1988 | McCulloh | 244/63 |
| 4,831,950 | A | * | 5/1989 | Allured | 114/39.1 |
| 5,732,642 | A | * | 3/1998 | DeSilva | 114/103 |
| 5,740,754 | A | * | 4/1998 | Harvey et al. | 114/273 |
| 5,896,825 | A | * | 4/1999 | Trefethen | 114/39.28 |
| 5,934,217 | A | * | 8/1999 | Allsop | 114/242 |
| 6,192,819 | B1 | * | 2/2001 | Larson et al. | 114/253 |
| 6,427,616 | B1 | * | 8/2002 | Hagen | 114/125 |
| 6,453,839 | B2 | * | 9/2002 | Roeseler et al. | 114/253 |

FOREIGN PATENT DOCUMENTS

| | | | | |
|---|---|---|---|---|
| SU | 1622220 | * | 1/1991 | 114/162 |

* cited by examiner

*Primary Examiner*—Stephen Avila
*Assistant Examiner*—Ajay Vasudeva
(74) *Attorney, Agent, or Firm*—Bell, Boyd & Lloyd LLC

(57) ABSTRACT

The present invention is for an elevated tow device made of a superstructure extending skyward from a towboat, where the superstructure raises an attachment point of a tether above 10 feet from the waterline, where the towboat is 25 feet or less in length, and a tether connecting the towboat to a towed subject. The present invention may further include an aerodynamic surface whose angular position is guided by the tether and which acts to stabilize the towboat as the towed subject applies lateral loads. When the towed subject pulls on the side of the towboat, the angle of attack on the aerodynamic surface increases proportionally, and the lateral forces approximately cancel. The towboat proceeds safely with little or no roll perturbation.

13 Claims, 7 Drawing Sheets

ELEVATED TOW APPARATUS

The present application is a continuation-in-part of U.S. patent application Ser. No. 09/772,426, filed Jan. 29, 2001, now pending, which claims the benefit of U.S. Provisional patent application Ser. No. 60/179,524, filed Feb. 1, 2000, the entire contents of each which are hereby incorporated by reference and relied upon.

BACKGROUND OF THE INVENTION

1. Field of the Invention

The present invention relates to a pylon or tower mounted towing device whereby a towrope or tether is elevated high above a waterline, and aerodynamic forces, which may be coupled to the towrope or tether for stabilizing and/or steering a tow vehicle.

2. Description of the Related Art

Wakeboarding has become the modern gymnastics of watersports. Competitive wakeboarders score points by vaulting from the wake of a towboat and flipping, twisting, and grabbing high over the water's surface. Higher, longer jumps are preferred. Towboats are modified to enhance the wakeboard experience and provide a better show for the spectators. Extra ballast is loaded into the boat and sometimes the hull is modified to form larger wakes. Superstructures such as pylons and towers extend upward from modern towboats to provide a higher towrope attachment. The higher attachment helps the rider to jump higher and stay up longer, but it sometimes has the adverse effect of rolling, and sometimes steering, the boat when the rider pulls hard outside the wake.

Several issues limit the practical height of the superstructure. The boat may need to be stored in a covered slip or shed where overhead clearance is limited. Ski or board racks, lights and/or stereo speakers may be mounted to the superstructure and should be accessible without climbing. The attachment point for the towrope should also be accessible without climbing. In the extreme case of a very tall superstructure on a small towboat, even the possibility of capsizing has limited the practical height of the superstructures to a height of about 7 feet.

A large population of 6–12 passenger towboats has emerged with extended pylons and towers furnished by the boat manufacturer or as an aftermarket accessory. Many of these larger family-sized vessels can support a tower or pylon extension well above 10 feet high without excessive rolling instability.

Much larger vessels, such as 30–50 foot sport fishing boats, are often equipped with much taller towers and sufficient speed to tow a wakeboarder, for example, but the bulky size, high cost, fuel consumption and awkward road handling make these impractical towboats.

When wakeboarding emerged as a trend-sport, tow pylons were extended to 6–10 feet above the water, and the thrust loads were transferred to the bow of the boat through the use of a forestay. The 6–10 foot high towers are now common, since they offer better lateral rigidity and speaker mounts. Correct Craft Inc. was issued a series of patents, which disclose various tower designs, towing methods and folding mechanisms.

Movable roll stabilizers are common on the hulls of larger vessels for the sole purpose of reducing the rolling action caused by unsteady seas. They are usually of the submersible type and act upon the hydrodynamic forces exerted as when a dorsal fin is rotated about an axis that is angled to nearly intersect the ship's centerline. Mechanical actuators and a feedback loop control them.

SUMMARY OF THE INVENTION

The present invention extends the practical heights of the superstructures substantially above 10 feet for towboats of 25 feet or less in length. If needed for stability, an aerodynamic surface is deployed to counter the side force of the towed subject, keeping the boat safe and level.

More specifically, the present invention discloses an elevated tow device, comprising a superstructure extending skyward from a towboat, where the superstructure raises an attachment point of a tether above 10 feet from the waterline, and where the towboat is 25 feet or less in length; and a tether connecting the towboat to a towed subject.

In another embodiment, the device further comprises an aerodynamic surface, where the aerodynamic surface is held aloft to stabilize the superstructure. In a more preferred embodiment, the aerodynamic surface comprises a leading edge, a trailing edge, a sail area and means to link the aerodynamic surface with the tether.

In further embodiments, the aerodynamic surface is supported cord-wise with battens; the sail area further comprises aerodynamic slots; and/or the sail area is sized to counter rolling moments applied by the towed subject.

In another embodiment, the attachment point is elevated by a structure selecting from the group consisting of a mast, a pylon, an A-frame, a shroud line, a forestay, a bridge and a tower.

In yet another embodiment, the towed subject is selected from the group consisting of a wakeboarder, an hydrofoil rider, a knee boarder and a waterskier.

In further embodiments, the aerodynamic surface may be folded down for stowage or road travel; the folded down aerodynamic surface supports a shelter against weather; the folded down aerodynamic surface is fixed to the towboat so as to block out harmful sun rays or to protect a boat crew from adverse weather; and/or the aerodynamic surface is used for advertisements.

In other embodiments, a halyard is used to raise the tether into towing position; or a halyard is used to raise the tether and the aerodynamic surface together.

In yet another embodiment, the device further comprises a modular extension, where the modular extension is added to the superstructure to further raise the attachment point of the tether.

In another preferred embodiment, the elevated tow device comprises a superstructure extending skyward from a towboat; a modular extension connected to the superstructure, where the modular extension and superstructure raise an attachment point of a tether above 10 feet from the waterline, and where the towboat is 25 feet or less in length; and a tether connecting the towboat to a towed subject.

DETAILED DESCRIPTION OF THE INVENTION

When towing a waterskier, wakeboarder or hydrofoil rider from a boat, it is sometimes beneficial to elevate the point at which the tether or towrope is attached. The use of extended pylons and towers have become commonplace on such boats, so that the towed subject is lifted by the ascending towrope. Extended pylons and towers also serve as mounting platforms for ski/board racks, speakers, and bimini tops. Currently, the practical height of an extended pylon or tower is typically less than 10 feet above the waterline (see FIG. 9). This patent application describes a superstructure, which may be added to or go in place of an existing superstructure to further extend substantially beyond 10 feet, the height at which the towrope originates for towboats of 25 feet or less in length (see, for example, FIGS. 1, 2 and 8).

When it is beneficial for a towing craft, such as a boat, to tow from a point high above its center, an airfoil may be fastened to the tether for improved roll and yaw stability. In the case of a wakeboarder, the upward tow angle afforded by a tall tower improves the wakeboarder's performance, but it sometimes causes the towboat to roll excessively when the wakeboarder pulls to the side. An aerodynamic surface can be linked to the tether to safely oppose the rolling moment of the wakeboarder. When the wakeboarder pulls out to the side of the towboat, the angle of attack on the aerodynamic surface increases proportionally, and the lateral forces approximately cancel. The boat proceeds safely with little or no roll perturbation.

The following numbers are used to designate the following elements throughout this application:

1. attachment point;
2. aerodynamic surface;
3. tether or towrope;
4. towed subject;
5. towing angle;
6. leading edge;
7. side force;
8. headwind;
9. heel angle;
10. slots;
11. force vector;
12. halyard;
13. downhaul;
14. towboat;
15. battens;
16. tower;
17. extension;
18. trailing edge;
19. pylon;
20. bimini top;
21. backstay;
22. forestay;
23. advertisement.

Figure 1:
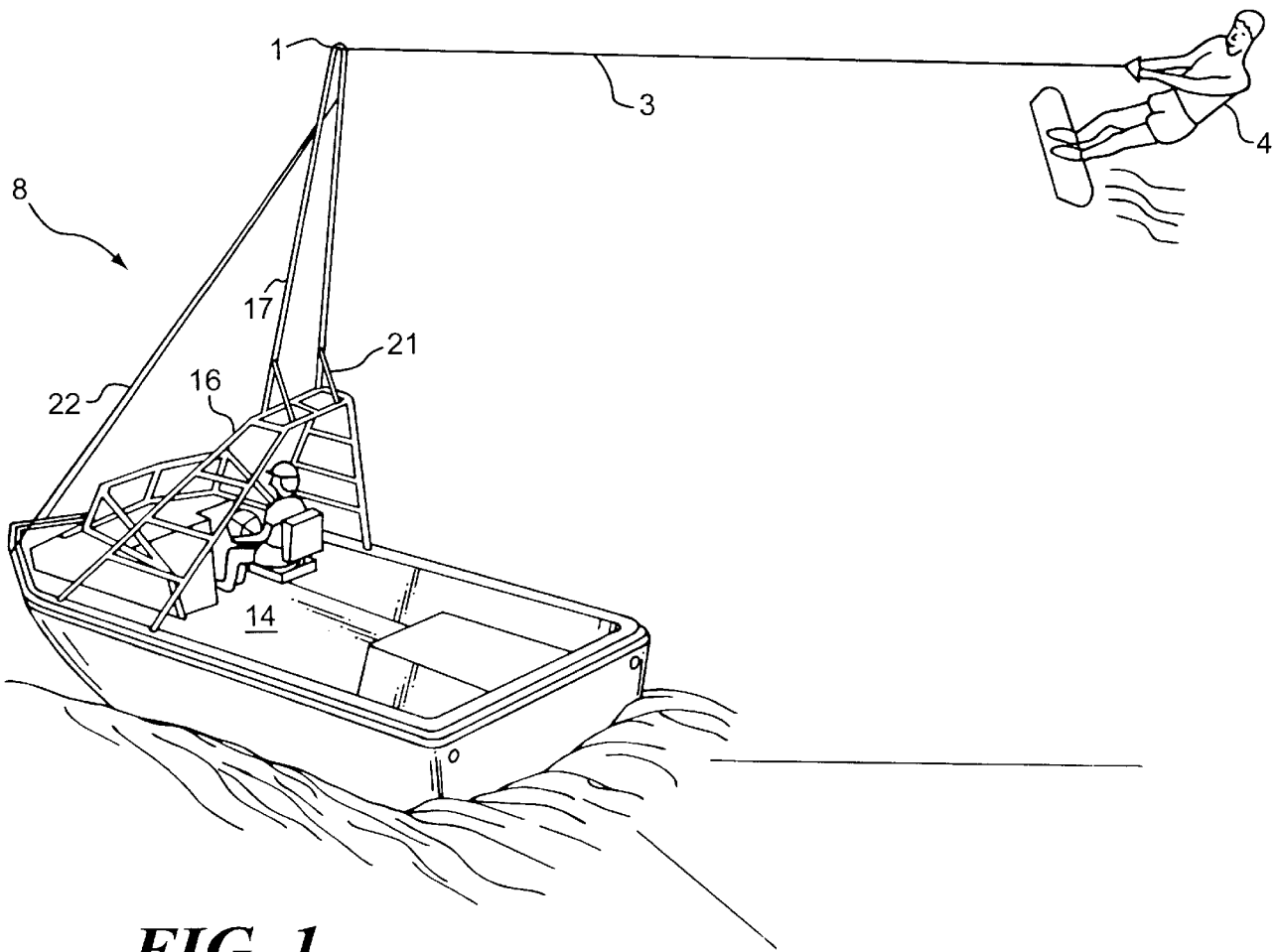
FIG. 1 is an isometric view of a towboat pulling a wakeboarder with the superstructure extended.

A modular extension may be added to an existing towboat superstructure to raise the attachment point 1 for a tether substantially above 10 feet (see, for example, FIG. 1). An arched extension is clamped to the cross member of the existing tower, and forestays 22 are added to react towing loads. Backstays 21 may be included to keep the modular extension from falling forward.

The stabilized embodiment of the present invention provides for a means to substantially raise the attachment point 1 for a tether 3 while maintaining, or even improving, the safety and seaworthiness of the towboat 14. The stabilized embodiment employs an aerodynamic surface 2 to counter the side force applied by the towed subject 4 (see, for example, FIG. 2). The attachment point 1 of the tether 3 is rigidly mounted to the hull structure by any combination of elevating means including, but not limited to pylons, A-frames, shroud lines, forestays, bridges and/or towers. It may have a swivel-type mount for the tether to reduce chaffing.

The aerodynamic surface 2 is comprised of a leading edge 6, a trailing edge 18, and an area of fabric that lies between said leading edge 6, and trailing edge 18. The aerodynamic surface 2 is tensioned vertically by a downhaul 13. A halyard 12 may be used to raise and lower the system, and rigid battens 15 may be used to keep the aerodynamic surface 2 taught. The towed subject 4 and tether 3 control the angular position of the aerodynamic surface with respect to the boat's centerline. When the towed subject steers itself to the starboard side of the towboat as in FIG. 2, the aerodynamic surface 2 uses the relative headwind 8 to force the attachment point 1 in the port direction. The angle of attack of the aerodynamic surface 2 on the headwind 8 varies proportionally as the towed subject steers itself harder to the side. Since the side force 7 (or lift $F_L$) generated by the aerodynamic surface 2 varies with angle of attack, the righting moment of the aerodynamic surface 2 increases in approximate proportion to the over-turning moment applied by the towed subject 4 (see FIG. 4). The matching of these moments is achieved by selecting the appropriate size and lift coefficient of the aerodynamic surface.

Figure 3:
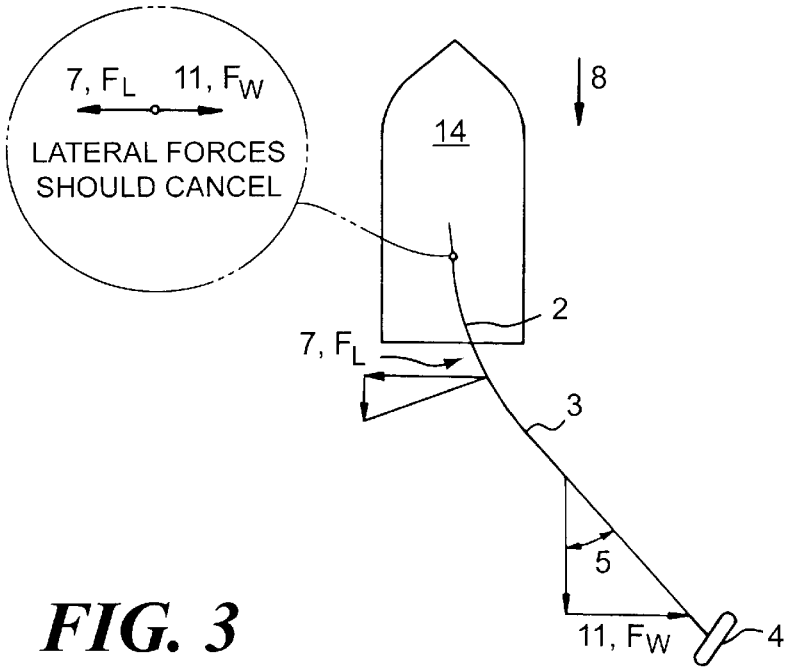
FIG. 3 is a top view force diagram showing the estimated forces exerted by the towed subject and the aerodynamic stabilizer on the towboat.

The rolling moment is calculated by multiplying the height of the attachment point 1 by the lateral component of the towrope force vector 11 when seen from the end view of the boat. The effect of lateral forces in a typical wakeboard application is depicted in FIG. 3.

The righting mechanism for a planing ski boat is largely governed by hull geometry. A wide, flat, hull with hard chines provides good roll stability for small roll angles. Beam is generally limited to about 7 feet to ease road travel while an automobile is towing the boat. Furthermore, an excessively wide mono-hull pounds and slaps its way through waves, while a narrower hull with a vee shape in the forward section cuts gracefully through the chop. It is for this narrower, more practical watercraft design that the stabilizer may provide the most benefit.

Figure 4:
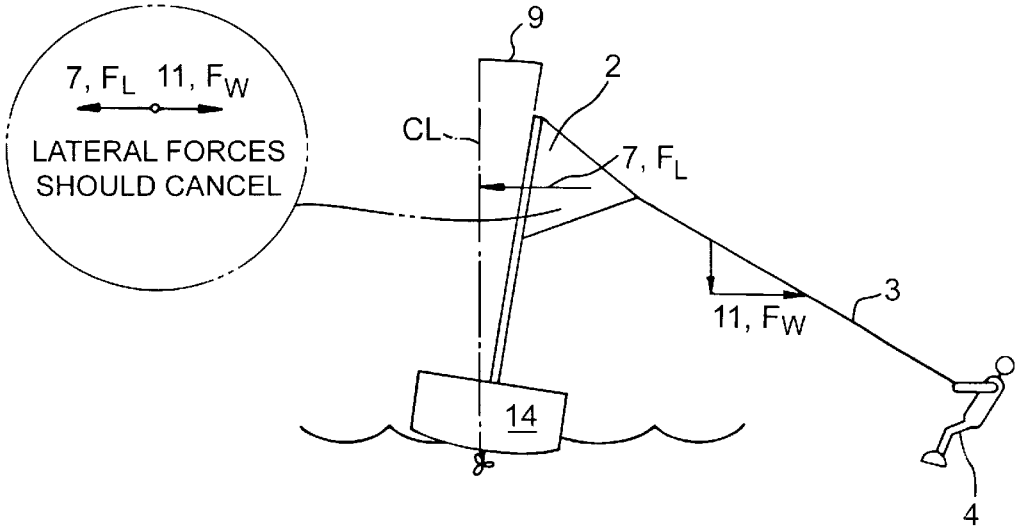
FIG. 4 is an end view force diagram showing the rolling moments applied by the towed subject, and the aerodynamic stabilizing force $F_L$ applied by the aerodynamic force.
Figure 6:
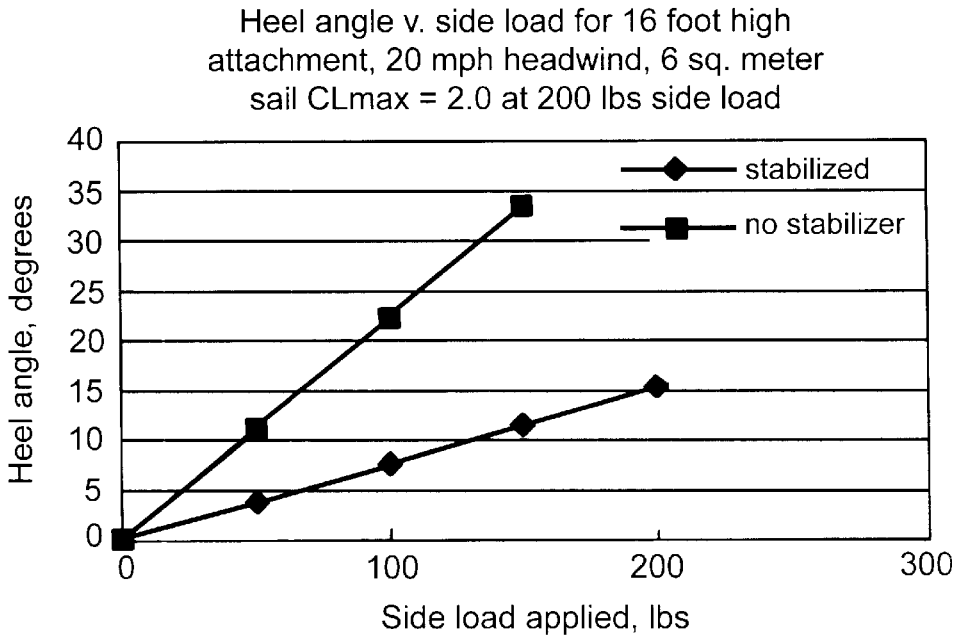
FIG. 6 shows the estimated heel angle plotted versus lateral load applied for a typical wakeboard situation. Heel angles are compared with and without the benefit of the aerodynamic stabilizer.

Since the purpose of the stabilizer is to stabilize the boat in the roll direction, the area of said aerodynamic surface 2 is optimized counter the lateral forces to keep the heel angle 9 to a minimum (see FIG. 4). When the towing angle 5 is equal to zero degrees, the boat's heel angle, 9 is substantially unaffected by the towed subject (see FIG. 6).

However, when the towing angle 5 is non-zero, the aerodynamic surface 2 assumes an attack angle on the relative wind 8. The required area for the aerodynamic surface 2 to counter the lateral component of the tow rope force vector 11 is determined by the following equation:

$$S=2F_L/C_L r\ U^2$$

Let $F_L$ equal $F_W$=500 Newton, the density of air at sea level be r=1.2 Kg/meter$^3$, relative wind 8 equals boat speed, U equals 8 meter/sec, and lift coefficient, CL for the aerodynamic surface 2 equals 2.0. Then S=6.5 meters$^2$ (71 ft$^2$).

Figure 5:
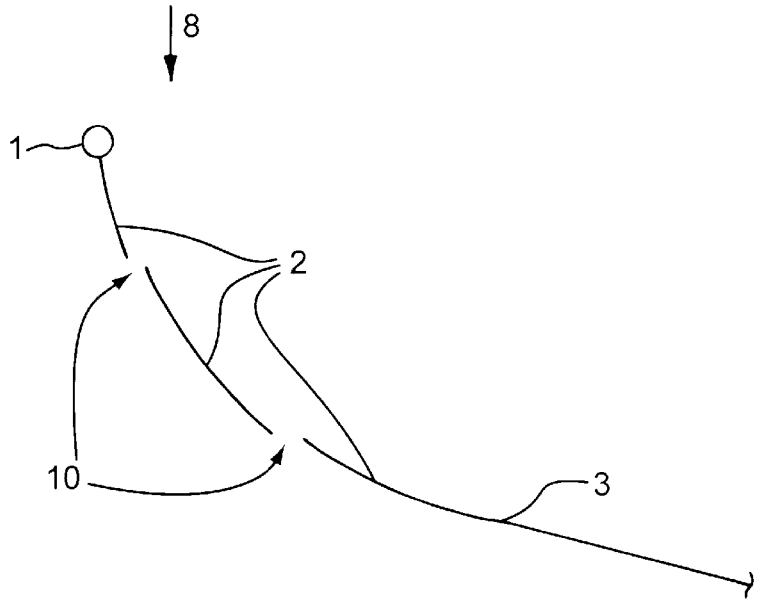
FIG. 5 shows that a slotted airfoil may be used as the aerodynamic surface for better lift coefficient and to prevent stall at high angles of attack.

To further enhance the performance of the stabilizer, slots 10, may be incorporated in the design of the aerodynamic surface 2 to achieve a higher lift coefficient (see FIG. 5). The slotted airfoil may also perform better at higher angles of attack.

Figure 2:
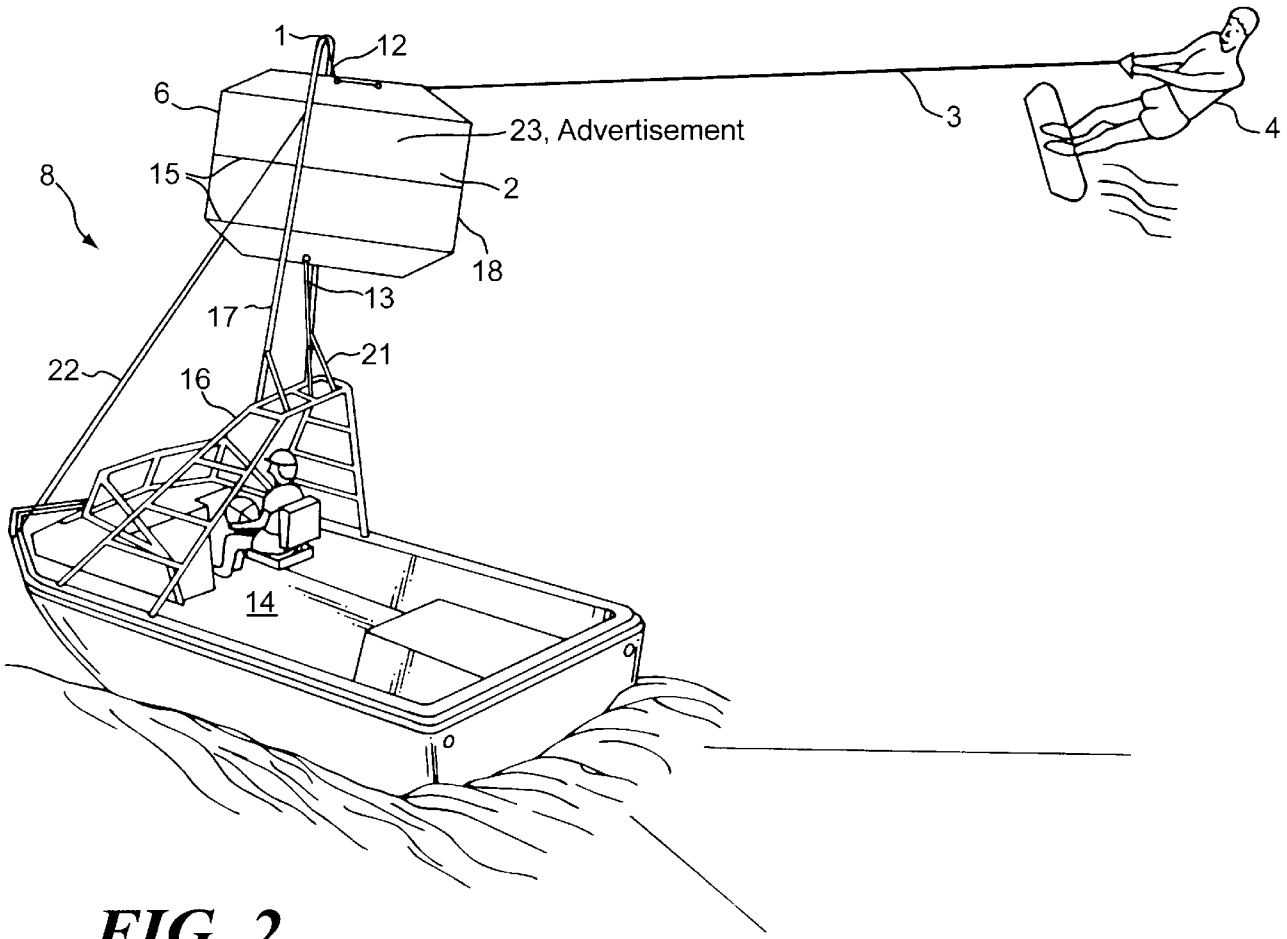
FIG. 2 is an isometric view of a towboat pulling a wakeboarder with the superstructure extended and aerodynamic surface deployed for stability.

For towboats 14 already equipped with a tower 16, an extension 17 may be added to further elevate the attachment point 1 and provide vertical support for the aerodynamic stabilizer 2 (see FIG. 2). Backstays 21 and forestays 22 provide support for the extension 17.

Figure 7:
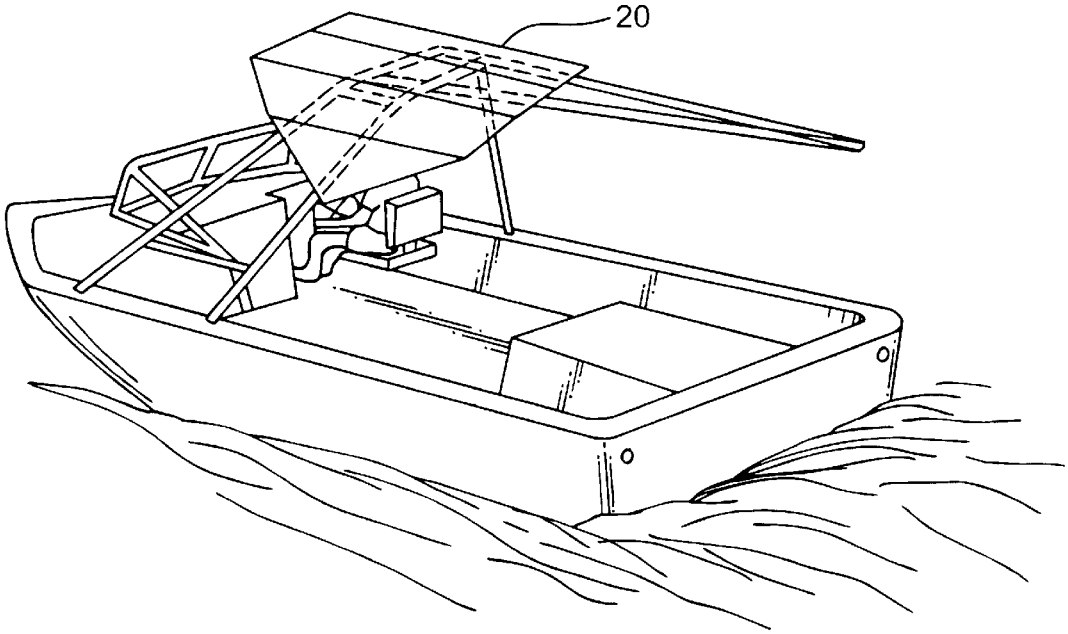
FIG. 7 shows the present invention in its stowed position (for road travel, etc.) as a bimini top for protection against harmful sunrays or rain.

Bimini tops (or sun-shades) are commonly found on recreational boats to block out direct sun rays. The present invention may take the form of a bimini top in its stowed position (see FIG. 7). The battens 15, provide for/aft structure for the aerodynamic surface 2, which becomes the fabric of the bimini.

Commercial advertisements are commonly found on recreational vessels. An aerodynamic surface held aloft is a prime target for such advertising 23. Publicists will likely use the aerodynamic surface for such advertising.

Figure 8:
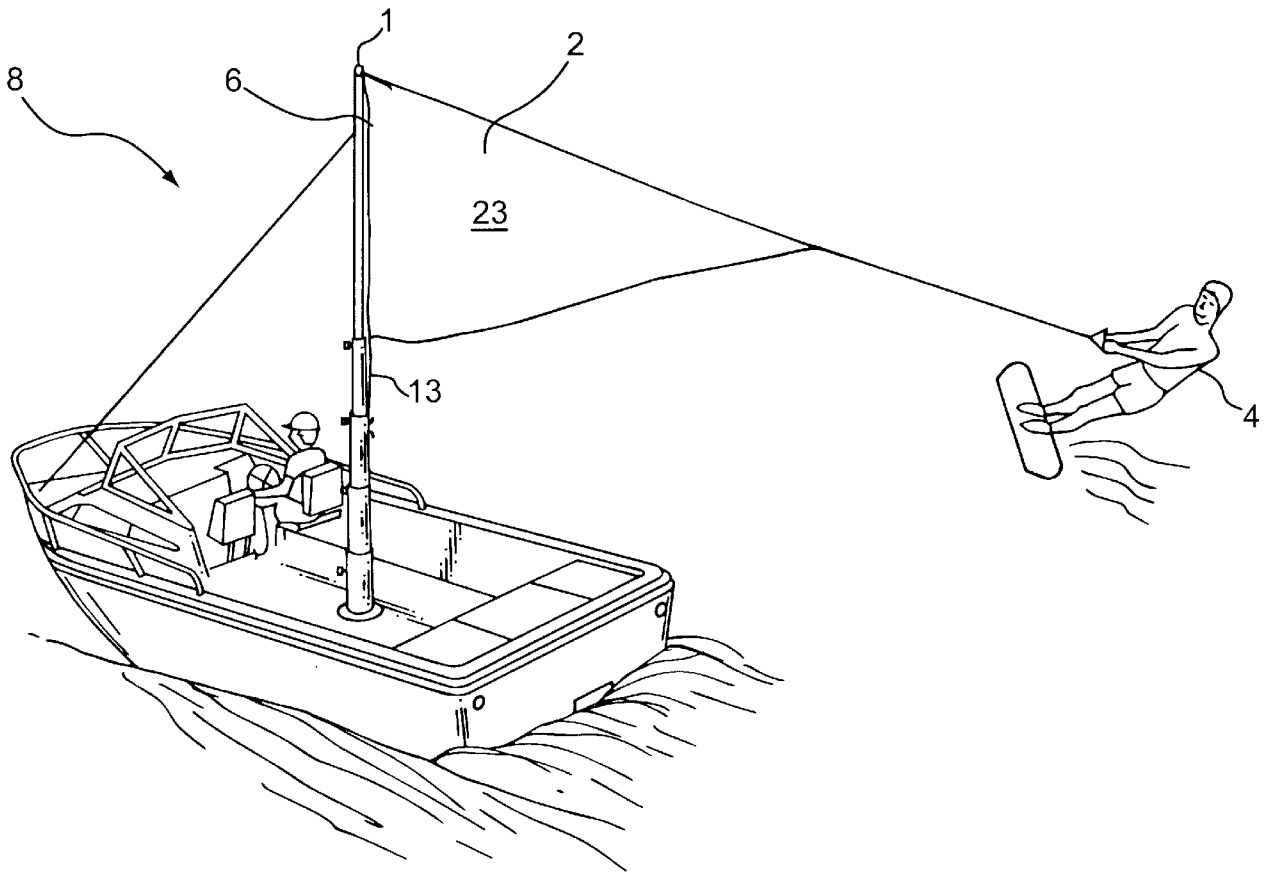
FIG. 8 is an isometric view of an alternative embodiment, whereby a towboat is equipped with a mast-like pylon 19, which supports a pennant-shaped aerodynamic stabilizer.
Figure 9:
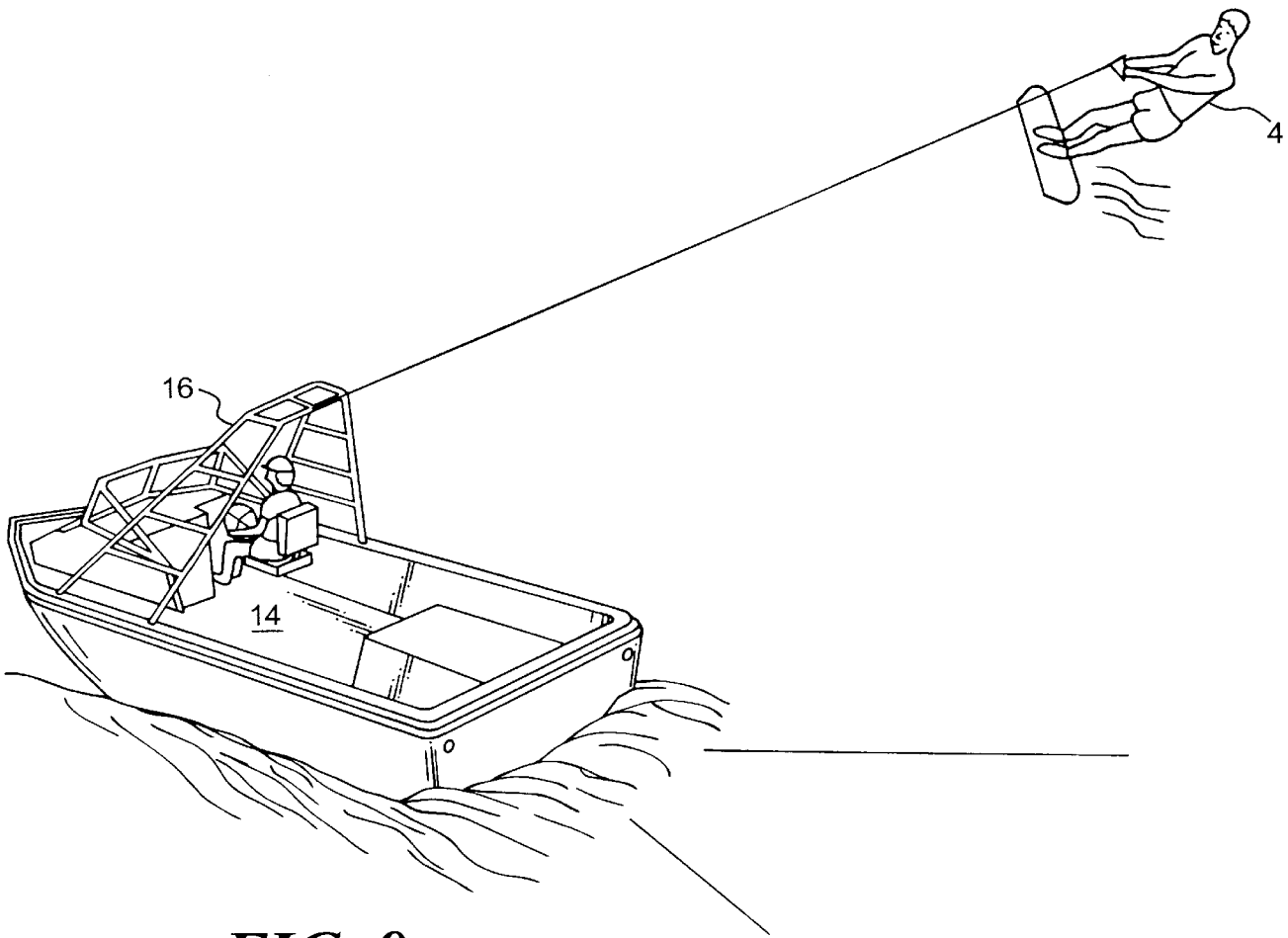
FIG. 9 (PRIOR ART)
FIG. 9 is an isometric view of the prior art, showing a typical tower superstructure on a runabout towing a wakeboarder.

An alternative embodiment of the present invention, whereby a towboat is equipped with a mast-like pylon 19, which supports a pennant-shaped aerodynamic stabilizer, is shown in FIG. 8. This embodiment does not mandate the use of battens 15, since the aerodynamic surface 2, remains aft of the attachment point 1 of the hard structure.

While the invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the appended claims.

Thus, it is to be understood that variations in the present invention can be made without departing from the novel aspects of this invention as defined in the claims. All patents, articles and references cited herein are hereby incorporated by reference in their entirety and relied upon.

What is claimed is:

1. An elevated tow device, comprising:

a) a modular extension to an existing superstructure extending skyward from a towboat;

wherein the superstructure raises an attachment point of a tether above 10 feet from a waterline, and wherein the towboat is 25 feet or less in length;

b) the tether connecting the towboat to a towed device, wherein the towed device is supported on water and the towed device is selected from a group consisting of a wakeboard, a hydrofoil, a knee board and a waterski; and c) an aerodynamic surface, wherein the aerodynamic surface is held aloft to stabilize the superstructure.

2. The device of claim 1, wherein the aerodynamic surface comprises:

a) a leading edge;

b) a trailing edge;

c) a sail area; and d) means to link the aerodynamic surface with the tether.

3. The device of claim 2, wherein the sail area further comprises aerodynamic slots.

4. The device of claim 2, wherein the sail area is sized to counter rolling moments applied by the towed subject.

5. The device of claim 1, wherein the aerodynamic surface is supported cord-wise with battens.

6. The device of claim 1, wherein the attachment point is elevated by a structure selecting from a group consisting of a mast, a pylon, an A-frame, a shroud line, a forestay, a bridge and a tower.

7. The device of claim 1, wherein the aerodynamic surface is adaptable to be folded down for stowage or road travel.

8. The device of claim 7, wherein the folded down aerodynamic surface supports a shelter against weather.

9. The device of claim 7, wherein the folded down aerodynamic surface is fixed to the towboat so as to block out harmful sunrays or to protect a boat crew from adverse weather.

10. The device of claim 1, wherein the aerodynamic surface is used for advertisements.

11. The device of claim 1, wherein a halyard is used to raise the tether into towing position.

12. The device of claim 1, wherein a halyard is used to raise the tether and the aerodynamic surface together.

13. An elevated tow device, comprising:

a) a superstructure extending skyward from a towboat;

b) a modular extension connected to the superstructure, wherein the modular extension and superstructure raise an attachment point of a tether above 10 feet from a waterline, and wherein the towboat is 25 feet or less in length;

c) the tether connecting the towboat to a towed device, wherein the towed device is supported on water and the towed device is selected from a group consisting of a wakeboard, a hydrofoil, a knee board and a waterski; and d) an aerodynamic surface, wherein the aerodynamic surface is held aloft to stabilize the superstructure.

* * * * *